United States Patent [19]

Sprague

[11] Patent Number: 4,551,612

[45] Date of Patent: Nov. 5, 1985

[54] WALL-CONTAINED ELECTRIC WATER HEATING TANK

[76] Inventor: William H. Sprague, R.R. #1, Box 264, Mead, Wash. 99021

[21] Appl. No.: 575,001

[22] Filed: Jan. 30, 1984

[51] Int. Cl.[4] ..... F24H 1/20; H05B 3/82; B65D 6/38

[52] U.S. Cl. ..... 219/312; 122/13 A; 126/361; 219/213; 219/306; 219/316; 220/18; 220/72

[58] Field of Search ..... 219/296, 297, 298, 299, 219/306, 307, 310, 312, 213; 220/18, 72; 122/13 A; 126/350, 361, 363, 362

[56] References Cited

U.S. PATENT DOCUMENTS

| | | | |
|---|---|---|---|
| 245,822 | 8/1881 | Haynes | 126/361 |
| 1,363,947 | 12/1920 | Youngblood . | |
| 1,383,034 | 6/1921 | Seimbille . | |
| 1,711,423 | 4/1929 | Morro . | |
| 1,715,683 | 6/1929 | Stevens | 220/72 |
| 1,820,458 | 8/1931 | Jankins . | |
| 1,899,839 | 2/1933 | Von Ruden | 219/298 |
| 1,917,980 | 2/1917 | Williams . | |
| 2,055,500 | 9/1936 | McLeod | 219/213 |
| 2,174,951 | 10/1939 | Shepherd et al. . | |
| 2,487,710 | 11/1949 | Hynes | 219/298 |
| 3,795,789 | 3/1974 | Malzoni et al. . | |
| 4,169,537 | 10/1979 | Sabreen et al. | 220/72 X |

FOREIGN PATENT DOCUMENTS

| | | | |
|---|---|---|---|
| 2126070 | 12/1972 | Fed. Rep. of Germany | 219/306 |
| 1211931 | 10/1959 | France | 219/312 |
| 609805 | 10/1960 | Italy | 219/306 |
| 620517 | 5/1961 | Italy | 219/306 |
| 46944 | 4/1981 | Japan | 219/298 |
| 451818 | 5/1968 | Switzerland | 220/72 |
| 573460 | 11/1945 | United Kingdom | 220/72 |
| 944881 | 12/1963 | United Kingdom | 219/310 |

*Primary Examiner*—A. Bartis

[57] ABSTRACT

A reservoir type electric water heating tank for containment within a void defined between the upper and lower plates, pair of spaced vertical studs and the opposing surface elements of a structural wall includes a relatively thin tank structure peripherally thermally insulated with thin rigid insulation and having a rectilinear configuration. The tank has two spaced opposed sides of substantial areal extent with vertical flutes therein to provide rigidity joined to a pair of elongate rectilinear vertical ends and horizontal top and bottom elements to define a chamber for containment of water to be heated. Structural brackets extend laterally from the upper and lower portions of the vertical ends of the tank to the peripheral surface of the thermal tank insulation and are secured by lateral extensions thereof to vertical post-like studs having laterally extending fastening brackets adapted to be secured to the plates of the structural wall. A plurality of electric immersion heating element are provided in the tank to heat the water.

2 Claims, 6 Drawing Figures

WALL-CONTAINED ELECTRIC WATER HEATING TANK

RELATED APPLICATIONS

There are no applications related hereto heretofore filed in this or any foreign country.

FIELD OF INVENTION

My invention relates generally to electrically powered, reservoir type water heating tanks and more particularly to such a tank of thin, rectilinear configuration to fit within a structural wall.

DESCRIPTION OF PRIOR ART

Heretofore the primary factor in the design of reservoir type water heaters of household capacity has been power efficiency and more particularly the creation thereof by preventing thermal loss. In general this had led to configurations providing a maximum of volume with a minimum of surface area which, when compromised for structural and mechanical considerations, has evolved to a cylindrical type device of varying height. Substantially all reservoir type water heaters used in mechanical systems of present day light frame construction are of this type and of a capacity commonly ranging from thirty to eighty gallons.

The cylindrical configuration of a water heater provides a reasonably thermally efficient device and in the past generally has been accepted structurally even though it tended to occupy a substantial amount of space within a structure. With the advent of materially higher building and financing costs of the present day, enclosed space and its use in housing structures has become of increasing concern and in general that space has declined substantially in quantity to provide much smaller structures and structural components. The use of space within such structures has become a problem of much more concern especially in the case of premanufactured housing and various types of mobile housing. In addition, for various reasons of architecture, economics and social desire, the use of basements has declined so that space therein commonly heretofore used for water heating devices is no longer available for that purpose.

By reason of these factors the placement and inclusion of the traditional cylindrical hot water tank in present day structures has become increasingly difficult and in some instances even practically impossible. My present invention seeks to provide a relatively thin, flat, rectilinear reservoir type water heater that may be incorporated in the ordinary vertical stud wall of a dwelling structure to use the space there not otherwise used and thus totally eliminate the space occupancy problems of the traditional cylindrically configured reservoir type water heater.

There have heretofore become known various rectilinear shaped water tanks but these have not been so thin as to allow placement in the spacial void of an ordinary stud wall of normal light frame construction because in general they have maintained traditional design characteristics emphasizing the attempt to prevent heat loss and have thereby generally assumed some form approximating a square. Some of these tanks have been partially embedded in a wall, but generally not completely so, and parts of them have projected from the wall to occupy space that could otherwise be used within a structure. Various cylindrical reservoir type water heaters have also heretofore been partially embedded in structural walls, but since the walls are commonly not more than six inches thick the general cylindrical configuration that has size appropriate to common water heating use must project substantially from a wall and known devices of this type have done so.

Another approach to the space occupancy problem of water heaters has been to provide a device that heats water upon transit therethrough at the time of use and provides no reservoir type storage for the heated water. Such devices do conserve space but have not been too practically operative or come into common use for general household water heating because they tend not to provide heated water at desired temperatures or in normally, desired volumes. These devices also tend to require substantial maintenance and to have a relatively short life, as deposits from water contained substances tend to accumulate in them more rapidly than in reservoir type water heaters.

The instant invention seeks to resolve these problems by providing a thin rigid water tank that is no thicker than the studs of a structural wall so that the tank may fit in a void defined between wall plates, opposed inner surfaces of wall covering and spaced adjacent studs. Though my tank has substantial surface area it provides peripheral insulation that lessens heat loss appropriately to provide reasonable efficiency, especially if the tank be incorporated within an inside wall not having external exposure.

My tank has metal studs at its two vertical ends to provide post type support in a wall structure that is traditionally provided by the wall studs, and also to aid in maintaining vertical rigidity and planarity of tank sides. Prior art tanks generally have not constituted or provided wall structural elements. My tank also provides the capacity of a traditional cylindrical reservoir type water heating tank in a space that occupies approximately a thirty-four inch horizontal expanse of a wall, and yet provides all traditional amenities of the present day electrically powered water heaters. My tank requires no specialized structure for its containment and will fit within an ordinary wall of traditional light frame construction of the present day building arts.

For those reasons and as hereinafter set forth my invention differs both structurally and functionally from reservoir type water heaters heretofore known, either individually or in any combination.

SUMMARY OF INVENTION

My invention generally provides an electrically powered reservoir type water heating tank that will fit within a void defined between opposed surfaces of an ordinary structural wall.

The tank is of a flat rectilinear configuration with a thickness substantially the same as studs of a containing wall. It has vertical metallic studs at each of its ends to provide post-like structural support for the area of a wall which it occupies and provides vertically fluted side surfaces to aid in maintaining planarity and rigidity thereof. The tank is peripherally insulated and provides multiple heating elements for thermal efficiency. It is serviced by traditional plumbing and electrical services available in residential structures and as heretofore used for existing water heaters. My tank provides the thermal adjustments and capacity of ordinary household type water heating tanks of the present day.

In creating such a device it is:

A principal object of my invention to provide an electrically powered, reservoir type water heater that fits within a void defined between opposed surfacing elements of an ordinary wall of light frame construction.

A further object of my invention to provide such a tank that has vertical metal studs at its ends to act as posts to support a containing wall structure at the point of my tank's incorporation therein.

A further object of my invention to provide such a water heating tank that has peripheral insulation and multiple heating elements to provide reasonable thermal efficiency similar to that of other reservoir type water heaters of different configuration and a lower ratio of surface area to volume.

A further object of my invention to provide such a water heating tank that requires no specialized wall construction for its embodiment and one that is serviced by ordinarily available mechanical systems of present day residential structures.

A still further object of my invention to provide such a device that is of new and novel design, of rugged and durable nature, of simple and economic manufacture and one otherwise well suited to the uses and purposes for which it is intended.

Other and further objects of my invention will appear from the following specification and accompanying drawings which form a part hereof. In carrying out the objects of my invention, however, it is to be understood that its essential features are susceptible of change in design and structural arrangement with only one preferred and practical embodiment being illustrated in the accompanying drawings as is required.

BRIEF DESCRIPTION OF DRAWINGS

In the accompanying drawings which form a part hereof and wherein like numbers of reference refer to similar parts throughout.

DESCRIPTION OF THE PREFERRED EMBODIMENT

My invention generally provides relatively thin reservoir type water heating tank 11, powered by electrical system 12 and supplied by plumbing system 13, that may be contained in a void defined within wall 10 between structural elements thereof.

Figure 1:
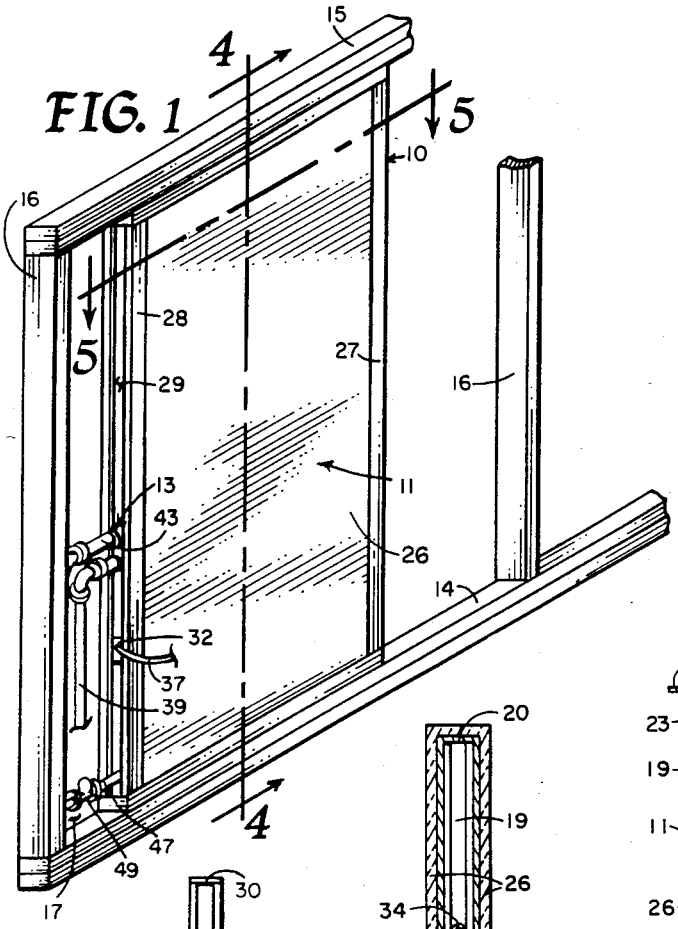
FIG. 1 is an isometric surface view of my water heating tank embodied in a typical stud wall structure of light frame construction.

A portion of typical stud wall 10 of ordinary present day light frame construction is illustrated in FIG. 1. It provides framework comprising bottom plate 14, generally formed of two by four studs laid on top of each other with their larger surfaces in horizontal orientation, and parallel top plate 15 formed in similar fashion and maintained at a spaced distance thereabove by a plurality of similar vertical studs 16 having a width (horizontal dimension perpendicular to the plates) the same as that of the two plate elements. Commonly studs 16 are positioned parallel to each other and perpendicular to the top and bottom plates with a spacing ranging generally from sixteen to thirty inches. Commonly the vertical distance between top and bottom plates will approximate seven feet. Flat, planar wall surface elements (not shown) are structurally maintained on each vertical side of the wall framework to form a completed wall. This type of wall defines internal voids 17, the periphery of which are formed by the vertical studs, top and bottom plates and the internal surfaces of opposed wall covering elements. It is within such internal voids that my water tank is maintained.

My water heating tank is illustrated in gross in FIG. 1 where it is seen to include similar opposed side elements 18 of some areal extent joined at their peripheral edges by similar vertical end elements 19, top element 20 and bottom element 21. These sheet-like peripheral elements that define my tank are all structurally joined at their adjacent intersecting edges. In the case illustrated the elements are formed of metal and are joined by welding. The side elements preferably are formed with elongate, vertical flutes 22 extending from top to bottom to increase the rigidity of these elements, especially in a vertical dimension. The exact shape of the flutes is not critical though that illustrated is preferred. Normally the flutes should present a planar outermost surface of some areal extent to allow better and more simple insulation of the peripheral surface.

Top element 20 of the tank extends beyond the lateral extension of the tank ends and is bent perpendicularly downward at each end to form similar opposed brackets 23, the external surfaces of which are configured to conform with the external surface of insulation to be placed around the tank. These brackets aid interconnection of lateral metal studs thereagainst. Bottom element 23 supports at each of its lateral end portions similar opposed fastening brackets 24 extending laterally therebeyond, each again with vertical legs having lateral surfaces flush with the external surface of insulation about the tank. The horizontal legs of these brackets provide depending feet 25 to aid in supporting the tank on an underlying surface and, again, these feet depend downwardly to a position that would be flush with the external surface of insulation that is to insulate the bottom element.

My tank is formed of some rigid, durable material, normally mild steel sheet with galvanized surfaces such as is commonly used in formation of cylindrical water tanks of present day commerce. Normally the material will be approximately one-sixteenth inch thick (14 gauge) to provide appropriate strength and rigidity and yet not develop excessive mass.

My tank is provided with relatively thin slab-like thermal insulation 26 about its periphery to prevent excessive heat loss therefrom. This insulation may be of various of the modern day types, but because of its dimension it necessarily must have a relatively high "K" factor to provide reasonable thermal efficiency. One of the foamed polymeric insulations such as styrofoam produces higher "K" factors and is more desirable from a manufacturing standpoint since it is at least semi-rigid and easily formable. The insulation may be applied in various fashions known in the present day insulations arts but commonly, as illustrated, I prefer to apply it in configured slabs by adhering it to the outer peripheral surface of the tank. The insulation should be reasonably carefully installed to present a continuous insulating surface about the entire tank and avoid voids to increase its effectiveness. The insulation must be appropriately configured to fit around the various projections and irregularities in the external surface of my tank and yet its thickness must be limited so that the total over all dimension of the tank structure will fit within the spacial void of an ordinary stud wall, commonly a space not more than thirty six inches wide, seven feet four inches in height and approximately four to six inches thick.

Figure 5:
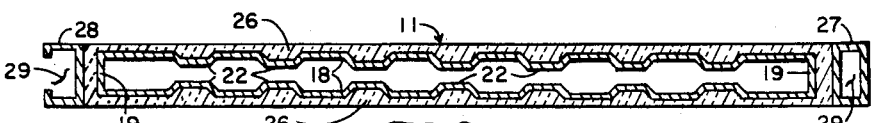
FIG. 5 is a horizontal cross-sectional view, enlarged twofold, of the tank of FIG. 1, taken on the line 5—5 thereon in the direction indicated by the arrows.

The vertical ends of my tank are provided with post-like studs normally formed of metal. Stud 27 is an ordinary metallic stud having a vertical length equal to the vertical height of the insulated tank and fastened to the tank by mechanical joinder to brackets 23, 24. It is provided with appropriate orifices 50, if required, to allow access to tank components and particularly heating elements. Stud 28 forming the other vertical edge, as shown especially in the cross-sectional view of FIG. 5, is an open faced stud to provide accessible chamber 29 to allow positioning and fastening of plumbing and electrical structures in an accessible manner. This stud also is cut to the overall vertical height of the insulated tank and is joined in the structure by mechanical affixation to the external surfaces of brackets 23, 24. The studs provide a structural post system to support horizontal plates or beams above my tank when it is embodied in a wall and allow means for attachment of the tank within the wall without damaging or requiring substantial modification thereof. These studs preferably provide horizontal, laterally projecting brackets 30 which are mechanically fastened in a structure, and in a typical wood frame structure by nails. Both studs define appropriate orifices where required to allow positioning of and access to the elements of the tank's mechanical systems.

Figure 6:
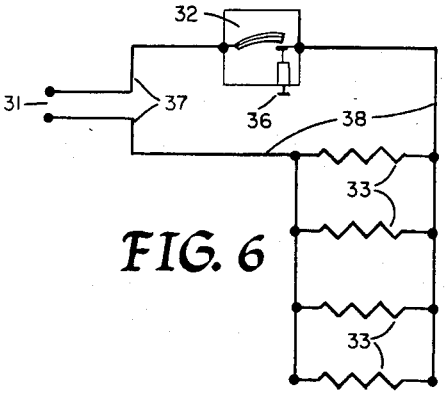
FIG. 6 is a circuit diagram in normal symbology of the electrical components of my water heating tank.

Electrical system 12 of my tank structure is illustrated diagrammatically in normal symbology in FIG. 6. Electrical power source 31 communicates in series through adjustable thermostat 32 and thence in parallel to plural resistance type heating elements 33. Normally the electrical power source will be of the ordinary household variety, single phase one hundred ten or two hundred twenty volt current for residential type construction. The adjustable thermostat is of the type commonly known in the water heating arts and readily available in present day commerce to regulate tank water temperature to a predetermined value, generally between about eighty to one hundred forty degrees Fahrenheit.

Heating elements 33 are of the common type presently used in cylindrical water heating tanks, each comprising an elongate resistance type electrical heating element encapsulated within an elongate rod-like cover 34 which provides fastening structure 35 in its outer end part for water tight interconnection with a hot water tank in an appropriate peripheral hole with the rod projecting inwardly to an operative position therein. I prefer that the heating elements have a length such as to extend into the tank near its medical portion but not therepast and I prefer to use four such elements spaced, as illustrated particularly in FIG. 3, with two elements positioned vertically about one third of the way downwardly from the top and the other two elements positioned approximately one third of the height of the tank upwardly from the bottom. Casement 34 obviously cannot have two large an external diameter as it must fit between the inwardmost surfaces of opposed flutes 22 of side elements 18. I prefer that the rods extend not more than half way through the tank for efficiency of water heating and to make removal of an inoperative rod, if necessary, more simple than were the rods longer. The wiring for the rods is provided externally of my tank and preferably along its outer peripheral surface. Adjustable thermostat 32 is positioned and structurally maintained on the external surface of one end element, as illustrated, with its associated control knob 36 projecting into the space defined within outwardly adjacent open stud 28 so that it may be accessible for adjustment. Electric lead 37 that interconnects the tank electrical system with an external powering source also exits from the thermostat housing and through stud 28 to an ordinary household wiring circuit.

Figure 3:
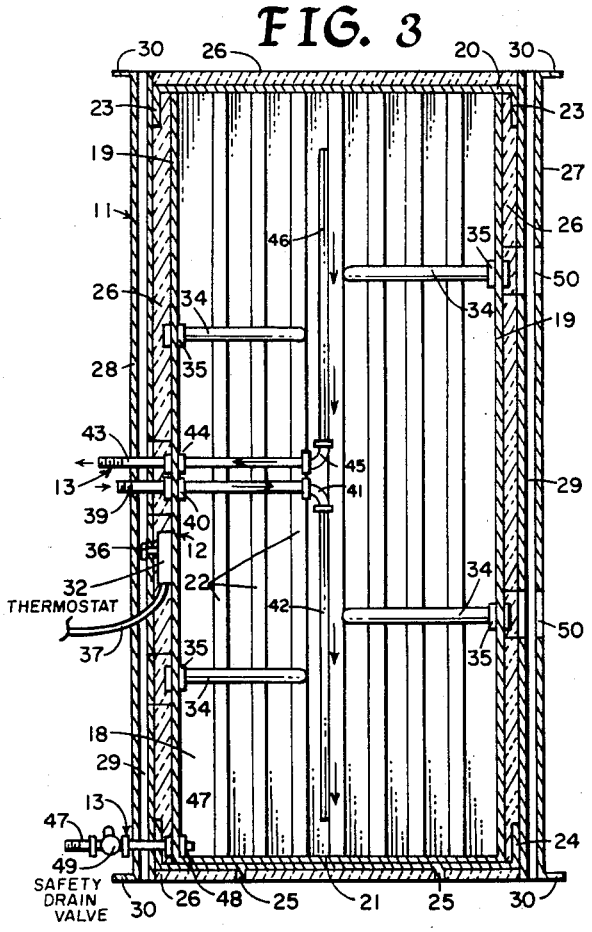
FIG. 3 is an orthographic side view of the tank of FIG. 1, with the insulation and one side surface removed to show internal structure.
Figure 4:
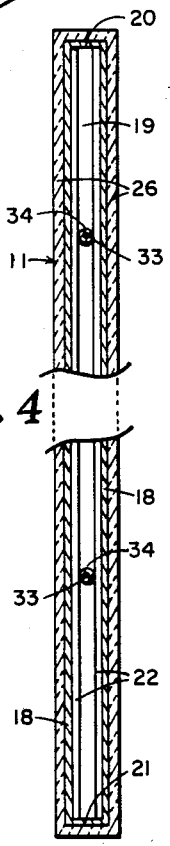
FIG. 4 is a vertical cross-sectional view, enlarged twofold, of the tank of FIG. 1, taken on the line 4—4 thereon in the direction indicated by the arrows.
Figure 2:
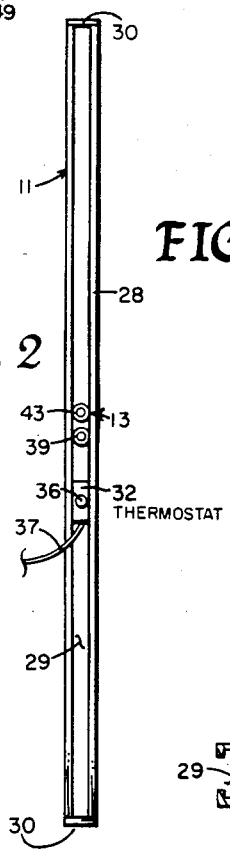
FIG. 2 is an orthographic end view of the tank illustrated in FIG. 1.

Plumbing system 13 of my invention is shown particularly in the cut-away view of FIG. 3. It provides input line 39 entering the vertically medial portion of the tank through open stud 28 and an appropriate hole in tank end 19 wherein the pipe is fastened in a water tight seal by fixture 40. The input line runs inwardly to the horizontally medial portion of the tank where it joins elbow 41 which interconnects depending internal input pipe 42 that extends downwardly to a position slightly above the bottom of the tank so that cooler water entering the tank may be introduced therein in the lower medial portion. Output line 43 also enters from the same side of the tank as the input line, through open stud 28 and through an appropriate hole in tank end element 19 where it is structurally maintained in water tight joinder by fixture 44. This pipe also extends inwardly to the horizontally medial portion of the tank where it interconnects with upwardly oriented elbow 45 which interconnects internal vertical output pipe 46 extending upwardly to a position at a spaced distance below tank top 20. This pipe allows heated water that has risen to the top of the tank to be the first removed to provide a warmer output than would be provided from the rest of the tank. Preferably both input and output pipes 42, 46 extend vertically between the ends of the heating element covers 34 so that no one of these elements will interfere with another. It is most convenient in using my tank to have the external ends of input line 39 and output line 43 extend laterally beyond stud 28 to aid interconnections therewith and it also normally is convenient to have the two pipes in reasonable adjacency.

Drain 47 should be provided in the tank both for safety and convenience. I prefer that this drain communicate through the lower portion of the plumbing end of the tank for convenience of access and installation though obviously it might communicate elsewhere through the lower part of the structure. The drain pipe enters the tank through an appropriate hole in the tank periphery and is structurally there maintained in water tight joinder by fixture 48. Obviously to be effective the drain must have its outlet port in the lowermost portion of the tank. It also provides valve 49 which is a combination manual shut-off valve and pressure relief valve so that if excessive pressure of water develops in the containment chamber defined by my tank the pressure may be relieved through drain pipe 47. This type of combination shut-off and pressure relief valve is a standard item of commerce in the plumbing arts and oftentimes used in other water heating devices. Drain pipe 47 communicates to a plumbing drain system of the structure in which my tank is contained for wastage of any water therein.

In regard the draining of my tank it is to be noted that input line 39 might be used to drain a substantial portion of the water from the containment chamber of the tank by siphoning action. Normally, however, this type of drainage is not particularly convenient of operation and it does leave a certain amount of water in the lower portion of the tank. Again, commonly, if a pressure relief valve be used in this line it would have to be provided with some secondary drainage system to allow removal of surplus water as the input line itself will be serviced by a pressurized plumbing line which might not allow the waste of water therethrough.

Both the electrical and plumbing systems of my invention are not new per se but are necessary to it to allow my water heating tank to be operative. Since the various elements of both are well known and are standard items of commerce they have not been described in specific detail.

Having thusly described my invention its operation can be understood.

Firstly a tank is formed according to the foregoing specification with a thickness, that is the distance between the two external surfaces of insulation adjacent the two tank sides 18, being no greater than and preferably substantially the same as the thickness of the frame elements of the wall in which the tank is to be placed. Commonly in light frame construction this will be either the thickness of a commercial two by four or a commercial two by six stud, though in some special instances it may range up to the thickness of a commercial two by ten stud. Similarly the peripheral configuration and dimensioning of the tank should be such as to fit within the void defined in a wall in which the device is to be placed. In ordinary light frame construction this will limit the vertical height to something less than seven feet four inches and, for convenience and structural considerations, the horizontal distance between vertical ends will not be more than thirty six inches. A tank within these size limitations and formed according to my specification will hold at least forty gallons of water, which is a size quite sufficient and reasonably standardized for normal household use in smaller single family dwellings.

To place the tank in an ordinary wall of light frame construction, framing elements are positioned immediately adjacent the position the top and the bottom of the tank are to occupy to leave a vertical void substantially the same as the height of the tank. Normally no vertical framing elements need to be positioned at the vertical ends of the tank and in fact they are not desirable, as such framing elements would interfere with mechanical systems connections and maintenance. After positioning of the tank within the void defined therefore, fastening brackets 30 are mechanically fastened to adjacent structural elements, normally by nailing. If desired or necessary the tank might be fastened by use of secondary structural elements such as blocking or additional frame elements according to the traditions of the light frame construction arts. Again, if fastening brackets 30 are not to be used they may be quite readily bent to a position where the do not interfere with the use of the tank or might be severed from the end studs 27, 28.

After the tank is placed, a pressurized cold water supply is attached in input line 39 and an output system to receive heated water is attached to output line 43 by traditional methods. A drain system is attached to drain pipe 47 to provide for drainage of any surplus water entering into the drain pipe, since this water may not be maintained within the structural wall containing the tank. The household electrical system is interconnected in a permanent fashion to electrical lead 37 to provide electrical power to the heating elements of the tank. In most light frame construction, water heating will be accomplished by single phase one hundred ten volt current though, if desired, the electrical heating system obviously may be engineered to use two hundred twenty volt current of one, two or three phase, and even of higher voltage.

After the tank is installed and its electrical and plumbing systems interconnected, the ordinary wall finishing may be applied to the two surfaces of the wall wherein my tank is contained. Commonly this finishing material will be drywall and it generally may be applied in the ordinary fashion of the present day building arts.

It is to be noted that where drywall is applied over the tank, the external surface of the insulation covering the tank sides will provide a surface to which drywall may be adhered. It is commonly desirable that the wall covering on at least one side adjacent the studs 27, 28 might be removable to allow access to plumbing and electrical systems to allow adjustment of water temperature in the tank and parts replacement if required. This obviously is not a necessity but does provide a convenience.

It is to be noted that there might be condensation of water from the ambient atmosphere on the plumbing pipes leading to or from my tank, depending upon various parameters and especially temperature and atmospheric moisture, but this problem is not more prevalent with my tank than with plumbing systems generally or with cylindrical reservoir hot water tanks of the present day commerce. The ordinary measures presently used to eliminate such sweating of pipes may be readily adapted for use with my invention.

It is further to be noted that though my preferred embodiment provides heating elements extending into the tank from both ends with medially positioned input and output pipes, it is possible to provide heating elements extending into the tank from only one end with internal plumbing at the other end. With either configuration the problem of possible heating element replacement must be kept in mind in designing adjacent structure.

The foregoing description of my invention is neccessarily of a detailed nature so that a specific embodiment of it might be set forth as required, but it is to be understood that various modifications of detail, rearrangement and multiplication of parts might be resorted to without departing from its spirit, essence or scope.

Having thusly described my invention, what I desire to protect by Letters Patent, and

What I claim is:

1. In an electrically powered reservoir type water heating tank the invention comprising, in combination:

a relatively thin peripherally insulated tank structure having a rectilinear configuration and dimensioned to be contained in a void defined within a structural wall between the upper and lower plates, opposing surface elements and a pair of spaced vertical studs of the structural wall, said tank having two spaced opposed vertical sides of substantial areal extent with vertically extending flutes therein to provide rigidity, two elongate rectilinear ends structurally joining the vertical edges of said sides in spaced relationship, and rectilinear planar top and bottom elements structurally communicating with said sides and ends to define a chamber for containment of water, said tank being supported by said bottom element from vertical displacement;

relatively thin rigid insulation covering the periphery of the tank to lessen thermal transfer therefrom, the external surface of said insulation defining a structure no larger than the void within a structural wall within which the tank is to be contained;

structural brackets extending laterally from the vertical ends of the tank to the peripheral surface of the insulation thereabout, at least at the upper and lower portions of each end; and vertically oriented post-like studs, structurally carried by the lateral extensions of said brackets at each vertical end of the tank, with each stud having fastening brackets extending laterally therefrom to aid the fastening of the tank within a wall.

2. A reservoir type, electrically powered, water heating tank for containment in a void defined wthin a stud wall of traditional light frame construction comprising, in combination:

a relatively thin rigid tank, with a rectilinear configuration similar to but smaller than the space within which the tank is to be contained, having two sheet-like vertical sides of substantial areal extent interconnected in parallel spaced relationship by sheet-like, elongate, vertical ends and similar sheet-like elongate, top and bottom elements, all structurally joined at adjacent edges to define a chamber for containment of water, said vertical sides having flutes defined therein to increase rigidity in a vertical direction and said tank being supported by its bottom element from vertical displacement;

relatively thin rigid thermal insulation covering the periphery of said tank to create a structure having peripheral dimensions no greater than the void within a structural wall that is to contain the tank structure;

plural brackets extending laterally outwardly from at least the upper and lower portion of each end of the tank laterally outwardly to the surface of the insulation thereabout with vertical studs structurally carried by each cooperating pair of said brackets, said studs having orifices defined therein to allow passage of and access to electrical and mechanical systems associated with said tank and each of said studs having fastening brackets to aid fastening of the tank within a stud wall;

electrical means for heating water contained within the chamber defined by the said tank; and plumbing means for introducing cooler water into said tank, removing warmer water therefrom and draining said tank.

* * * * *